United States Patent [19]

Franck, III et al.

[11] 4,455,954

[45] Jun. 26, 1984

[54] LATERAL POSITION ADJUSTER FOR EDGE MARGIN OF LONGITUDINALLY CONVEYED FLEXIBLE MATERIAL

[75] Inventors: William F. Franck, III; Bobby J. Cooke, both of Martinsville, Va.

[73] Assignee: Tultex Corp., Martinsville, Va.

[21] Appl. No.: 449,643

[22] Filed: Dec. 14, 1982

[51] Int. Cl.[3] ..... D05B 97/00; D05B 35/10; D05B 27/00

[52] U.S. Cl. ..... 112/262.3; 112/153; 112/304; 112/306; 112/308; 112/DIG. 2

[58] Field of Search ..... 112/306, 304, 308, 309, 112/303, 153, 152, DIG. 2, DIG. 3, 262.3, 262.1

[56] References Cited

U.S. PATENT DOCUMENTS

| | | | |
|---|---|---|---|
| 3,631,826 | 1/1972 | Morgan | 112/153 X |
| 3,886,877 | 6/1975 | Akaishi et al. | 112/DIG. 2 |
| 4,186,674 | 2/1980 | Conner, Jr. | 112/DIG. 2 |

*Primary Examiner*—H. Hampton Hunter

*Attorney, Agent, or Firm*—Cushman, Darby & Cushman

[57] ABSTRACT

A succession of like textile fabric pieces is placed in a series on a conveyor which runs through an automated sewing station. There is some space between individual pieces. Immediately prior to the sewing station, the lateral disposition of a critical site on the piece about to be sewn and then being sewn is automatically sensed and, if necessary, automatically shifted to a uniform disposition. Preferably any error in original placement of the pieces is in placing the edge too far over in one lateral direction, so that if any adjustment is necessary, it takes the form of pushing the respective fabric piece edge margin laterally of the conveyor toward the opposite edge of that fabric piece. Thus, it is generally not necessary to laterally drag the whole fabric piece laterally of the conveyor, but only necessary to move a small marginal portion of the fabric piece. The necessary movement preferably is effected by a narrow, needle-like air jet which points generally upwardly, but can be automatically arcuately moved about a horizontal axis which extends longitudinally of the conveyor run. A control system incorporating a microprocessor is described. A typical use of the invention is for the sewing rib-knit cuff strip onto fleece-knit sweatshirt sleeve ends and rib-knit waistbanding on the lower edge of fleece-knit jacket bodies.

14 Claims, 16 Drawing Figures

Fig. 13

| TIME DELAY DEVICE NO. | ACTIVE WHEN TOGGLE IS SET TO | CONTROL DELAY FOR THIS FUNCTION | TYPICAL DELAY SETTING IN MILLISECONDS |
|---|---|---|---|
| T01 | EITHER | RIB FEED DELAY | 1200 |
| T02 | EITHER | ENABLE EDGE GUIDE DELAY | 1020 |
| T03 | EITHER | SEW DELAY=RIB FEED HIGH DWELL | 420 |
| T04 | JACKETS | JACKET FRONT DWELL | 940 |
| T05 | SWEATSHIRTS | RIB FEED SLOW DELAY | 60 |
| T06 | JACKETS | JACKET RIB FAST DELAY | 170 |
| T07 | JACKETS | JACKET RIB STOP DELAY | 1500 |
| T08 | SWEATSHIRTS | SWEATSHIRT RIB STOP DELAY | 770 |
| T09 | EITHER | EDGE GUIDE DWELL | 1000 |
| T10 | EITHER | STOP SEW DELAY | 1520 |
| T11 | EITHER | RIB CHOP DELAY | 10 |
| T12 | EITHER | RIB CHOP DELAY | 60 |
| T13 | EITHER | RIB FEED FAST DELAY | 20 |
| T14 | SWEATSHIRTS | RIB FAST DWELL | 10 |
| T15 | EITHER | BRAKE DWELL | 250 |
| T16 | EITHER | CHAIN TRIM DELAY | 300 |
| T17 | EITHER | CHAIN TRIM DWELL | 60 |
| T18 | EITHER | STACKER DELAY | 1600 |
| T19 | EITHER | STACKER DWELL | 300 |
| T20 | EITHER | DOFFER DELAY | 1000 |
| T21 | EITHER | DOFFER DWELL | 1000 |

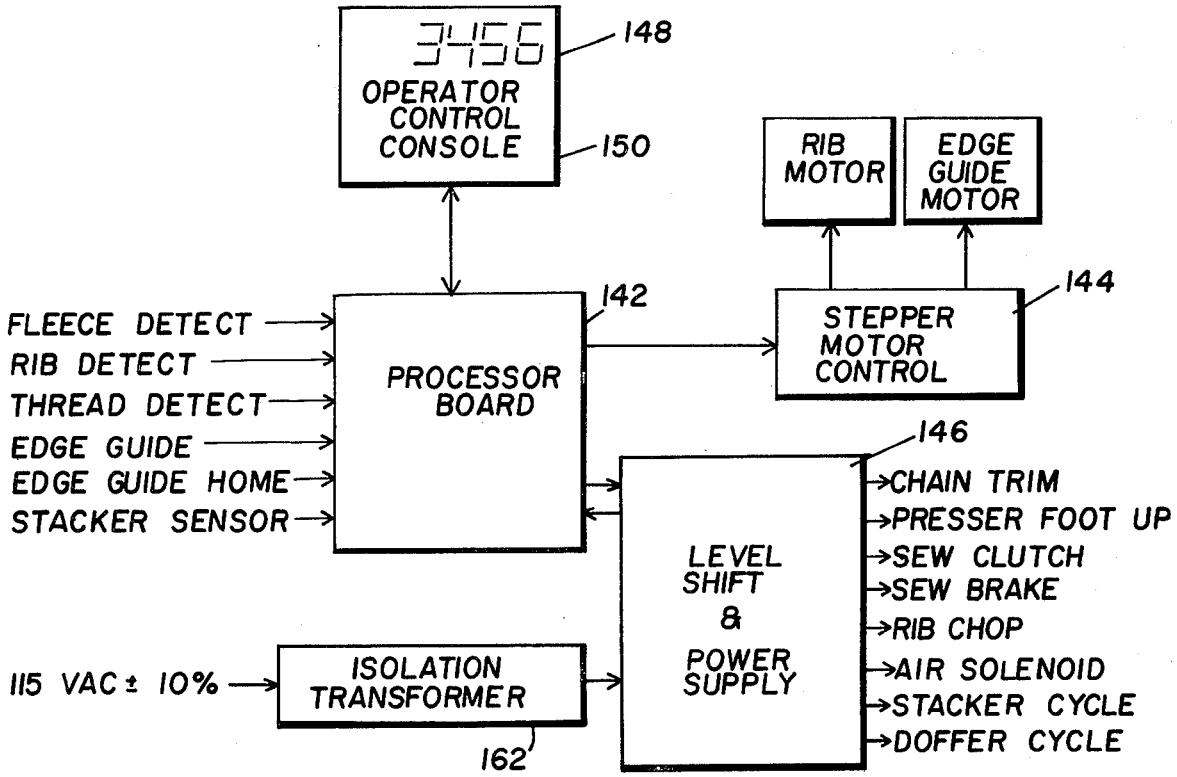
Fig. 14
Fig. 15
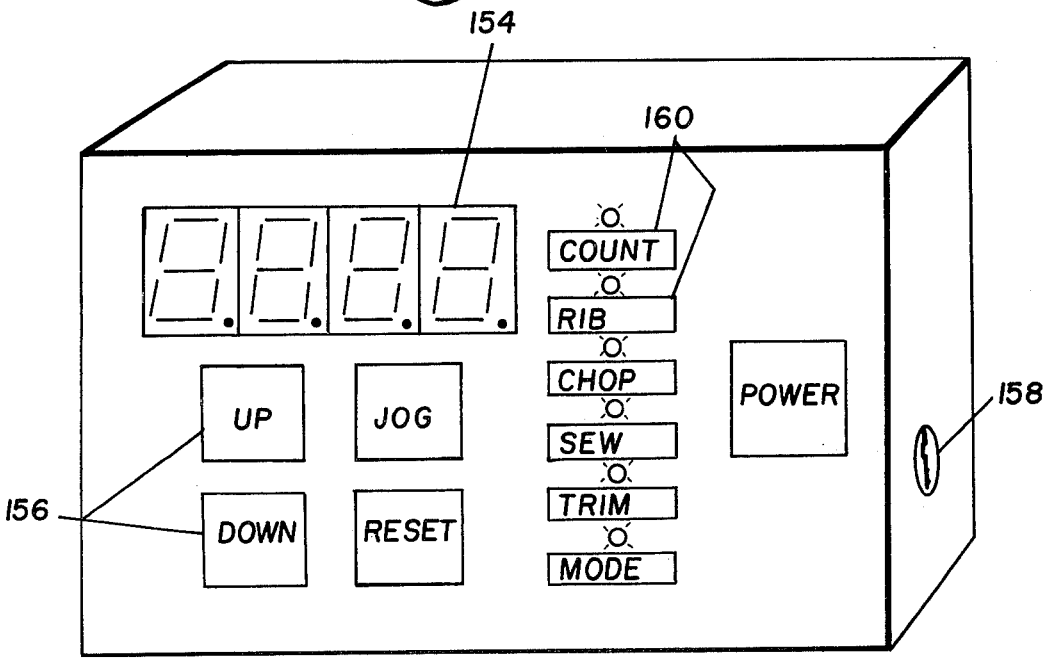

LATERAL POSITION ADJUSTER FOR EDGE MARGIN OF LONGITUDINALLY CONVEYED FLEXIBLE MATERIAL

BACKGROUND OF THE INVENTION

There are many instances in the manufacture of apparel and other goods from pieces of woven or knitted textile fabric and the like where, at a sewing station, or similar bonding or uniting station, two elements of fabric or the like must be precisely juxtaposed and moved along a path through the work station. The task is so complex that even in an otherwise highly automated plant this part of the work relies largely on human operators.

Often what is to be accomplished at the station involves uniting the two elements along a straight line. Frequently, the two elements are not of the same size or shape, or even of the same material. Typically, although not necessarily, the two elements are physically stacked one on the other as the two enter the work station, in such a manner that an edge of one is longitudinally and vertically aligned with an edge of the other, and the sewing, bonding or other uniting is accomplished along a line that is parallel to but set back from the aligned edges by some predetermined fraction of an inch.

The task is further complicated in instances where one of the elements is roll fed and the other is in the form of discrete pre-cut pieces, or where one element is of a doubled-over two-ply nature or is made of more stretchable material than the other, and especially where one element is intentionally made shorter than the other by a predetermined amount, and needs to be stretched in a controlled manner while passing through the work station.

Illustrative of the general task is the instance where rib-knit cuff material is to be sewn to the outer end margin of a fleece-knit sweatshirt sleeve, at a stage where the sleeve is still a flat piece of fabric which has neither been joined to itself along opposite longitudinal edges, nor been joined at the upper end to a sweatshirt body. Another instance is where similar rib-knit waistbanding is to be sewn to the lower edge margin of a jacket, or a sweatshirt body whether tube knit, or the upper edge margin of leggings, pants, shorts, trunks, trousers and the like, as well as to provide cuffs at the lower edge margins of such garments full-zippered or the like. Yet other instances are the tasks of sewing decorative stripes along the sleeves of sweatshirts and similar garments and along the legs of sweatpants and the like. Some more highly-styled or fashionable garments, for instance jogging suits, are manufactured of much the same material and by much the same processes, where the same or similar tasks heeds to be performed. A further instance is the task of sewing a zipper to the body of a so-called full zip hood sweatshirt. It is probable that similar tasks need to be performed on similar material out of the apparel construction art, e.g. in the manufacture of furniture upholstery, vehicle seating, seat covers, slip-covers, drapery, tents, back-packs, baby carriers and the like.

Although the principles of the invention are believed to have applicability across the broad field just described, it happens to have been devised as apparatus and a method for attaching rib-knit cuffs to fleece knit sweatshirt sleeve ends and rib-knit waistbands to the lower edge margins of fabric-knit jacket bodies, and for illustrative purposes are particularly described in relation thereto in this dodument, in the belief that, once the principles are set forth, ways and means for adaptation to any analogous tasks at hand will become readily apparent to those skilled in the art.

SUMMARY OF THE INVENTION

A succession of like textile fabric pieces is placed in a series on a conveyor which runs through an automated sewing station. There is some space between individual pieces. Immediately prior to the sewing station, the lateral disposition of a critical site on the piece about to be sewn and then being sewn is automatically sensed and, if necessary, automatically shifted to a uniform disposition. Preferably any error in original placement of the pieces is in placing the edge too far over in one lateral direction, so that if any adjustment is necessary, it takes the form of pushing the respective fabric piece edge margin laterally of the conveyor toward the opposite edge of that fabric piece. Thus, it is generally not necessary to laterally drag the whole fabric piece laterally of the conveyor, but only necessary to move a small marginal portion of the fabric piece. The necessary movement preferably is effected by a narrow, needle-like air jet which points generally upwardly, but can be automatically arcuately moved about a horizontal axis which extends longitudinally of the conveyor run. A control system incorporating a microprocessor is described. A typical use of the invention is for the sewing rib-knit cuff strip onto fleece-knit sweatshirt sleeve ends and rib-knit waistbanding on the lower edge of fleece-knit jacket bodies.

The principles of the invention will be further discussed with reference to the drawings wherein a preferred embodiment is shown. The specifics illustrated in the drawings are intended to exemplify, rather than limit, aspects of the invention as defined in the claims. The edge guider could be used in the same manner on similarly flexible material in a non-sewing context.

BRIEF DESCRIPTION OF THE DRAWINGS

In the Drawings

FIG. 13 is a tabulation of typical sensor time delays for the control system of the rib attachment machine;

FIG. 14 is a simplified electrical and control diagram; and

FIG. 15 is a larger scale diagrammatic view of a preferred layout of the operator's control panel;

DETAILED DESCRIPTION

Figure 1:
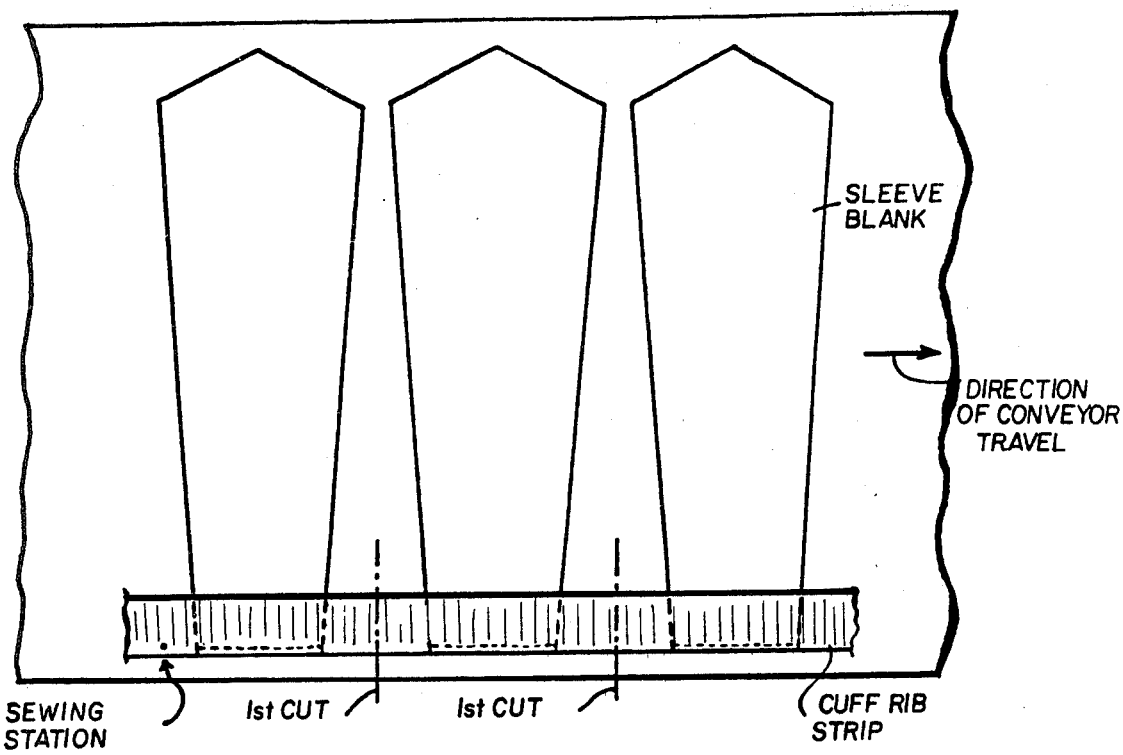
Fig. 1 (PRIOR ART)
FIG. 1, for illustrative purposes, is a diagrammatic top plan view of a PRIOR ART rib attachment system.

In a known system illustrated in FIG. 1, sweatshirt sleeve blanks SB are serially placed in a single row on a horizontal conveyor belt CB so that each extends crosswise of the belt (which is travelling to the right as seen by the arrows A in FIG. 1). The blanks SB are practically shoulder-to-shoulder, but because they are narrower at the wrist end than at the shoulder end there are gaps between adjacent blanks at their wrist ends. Upstream of the sewing station, which is indicated by a dot and legend at the site of sewing needle vertical reciprocation for stitch insertion, a strip of doubledover rib-knit fabric CR is continuously payed out from a roll, so that its juxtaposed edges E1, E2 are approximately juxtaposed with the wrist-end edges WE of the sleeve blanks SB. At this time the face of the cuff ribs that will become the outside lies face down upon the upwardly presented outside surface of the sleeve blanks SB. At the sewing station, a human operator laterally adjusts the sleeve blank relative to the rib strips, so that edges E1, E2 and WE are more precisely juxtaposed and as the thus-arranged plies go through the sewing station, the cuff rib strip CR is sewn to the sleeve blank SB producing a seam line S that closely parallels the juxtaposed edges. Typically the sewing apparatus at the sewing station is provided with an edge trimmer which cuts-off any slight excess material. However, due to the high volume of throughput, and the tendency of a human operator to let the machine trim off some excess rather than risk sewing a seam where one of the plies is not fully caught in the seam, the trimmed-off excess may amount to several thousands of dollars worth of waste on an annual basis.

After the cuff rib strip is sewn to the sleeve blanks at the sewing station, the cuff rib strip of the resulting unit is cut apart, about half-way between each two adjacent sleeve blanks, as indicated by the legend CUT. This cut often is made manually or semi-automatically, because there is a considerable margin for error in placement of the cut.

Figure 2:
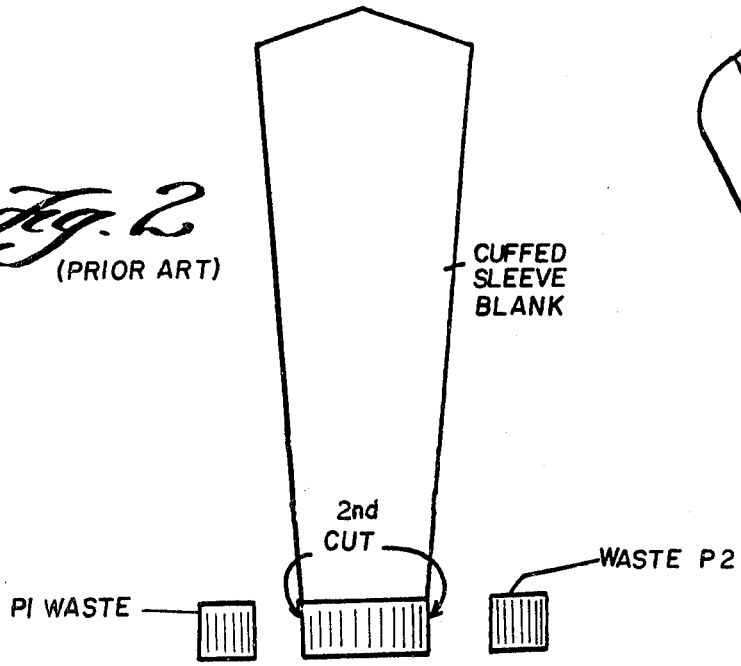
Fig. 2 (PRIOR ART)
FIG. 2 is a perspective view of a cuffed sleeve blank made by the PRIOR ART system of FIG. 1, showing the rib folded out and the two segments of rib waste trimmed away.
Figure 3:
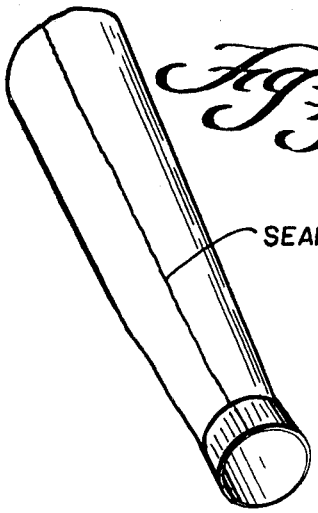
FIG. 3 is a perspective view of a cuffed sleeve sewn from the cuffed sleeve blank of FIG. 2.
Figure 4:
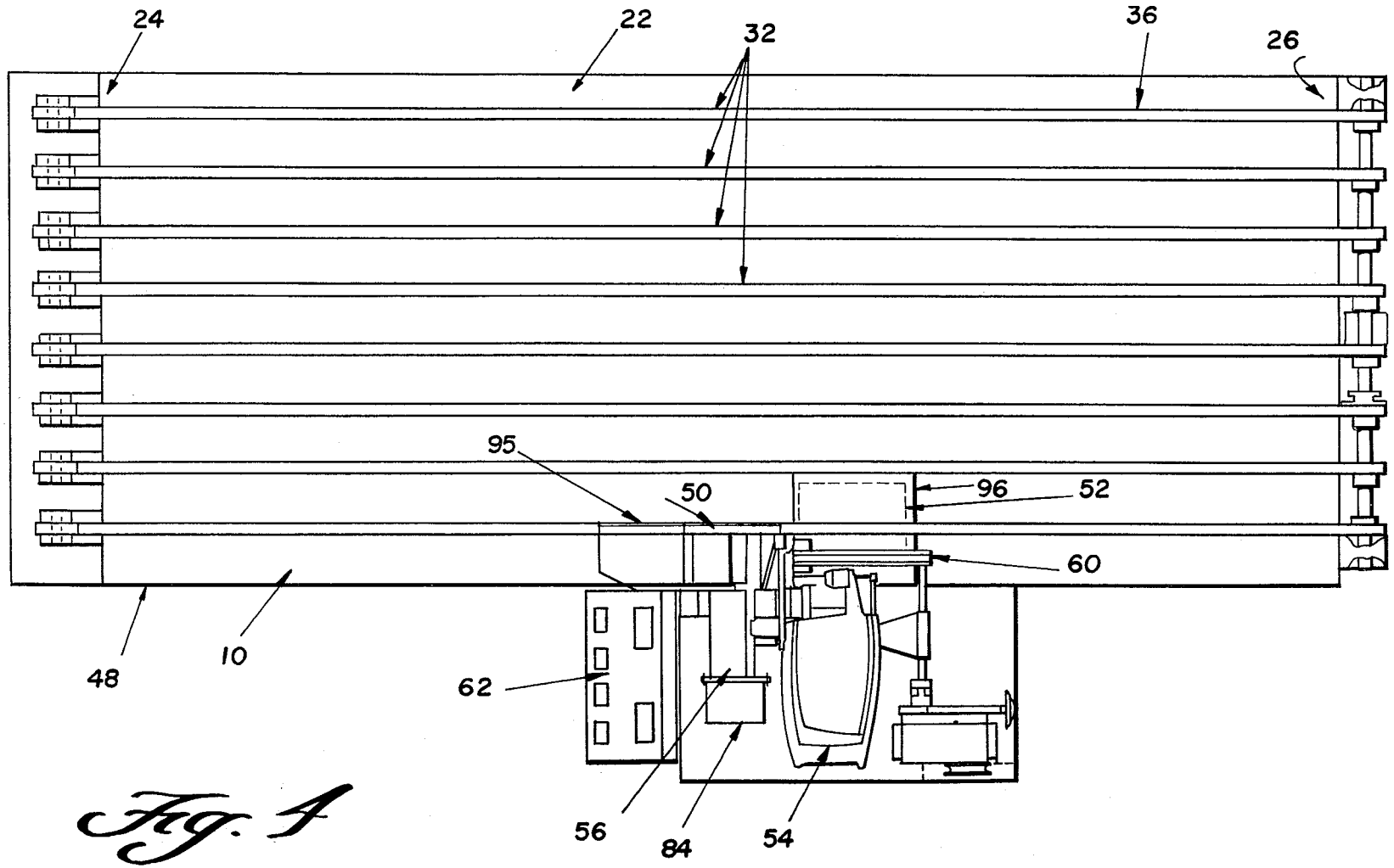
FIG. 4 is a top plan view of a rib attachment machine embodying principles of the present invention.
Figure 5:
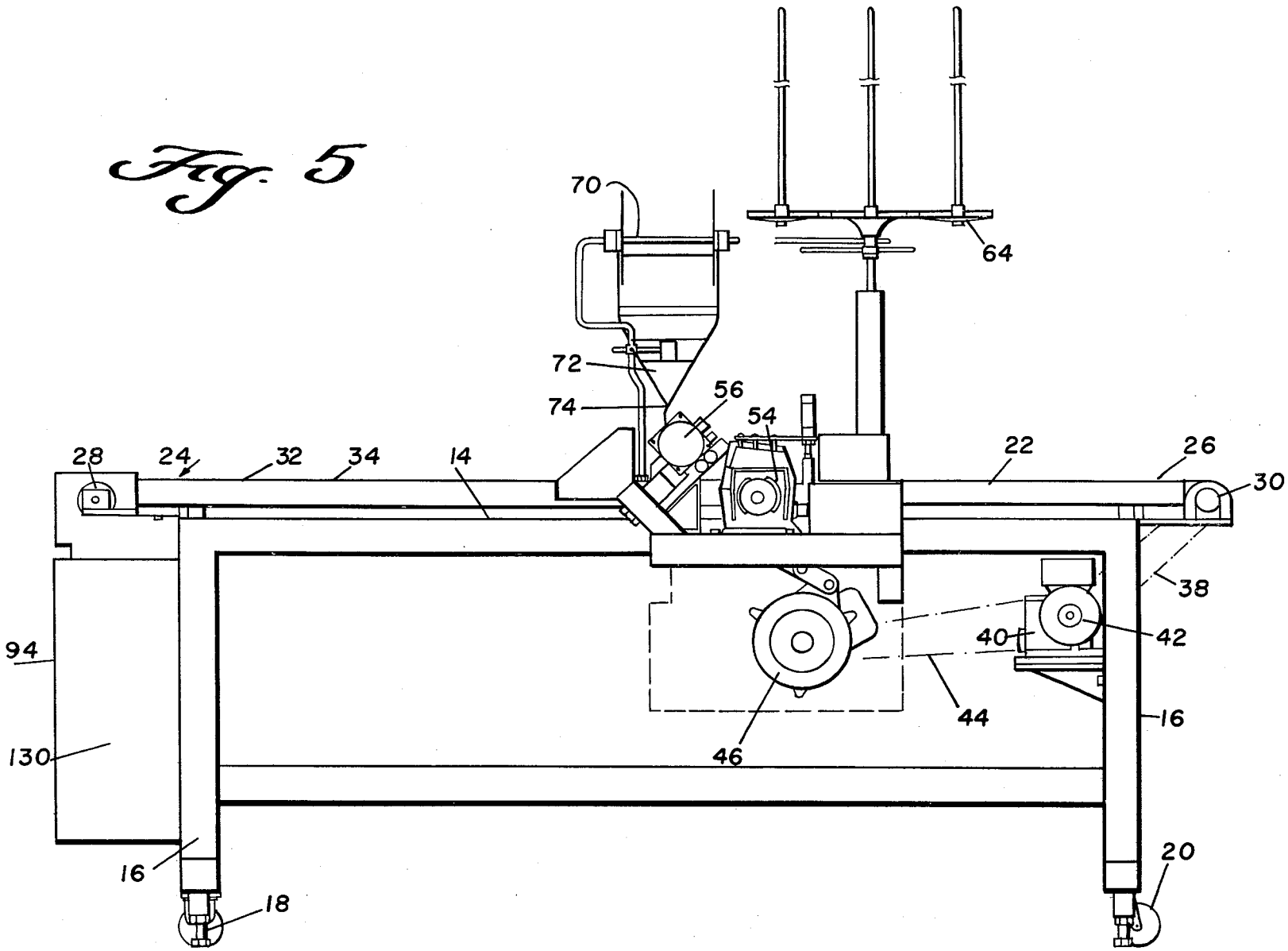
FIG. 5 is an operator's side elevation view thereof.
Figure 7:
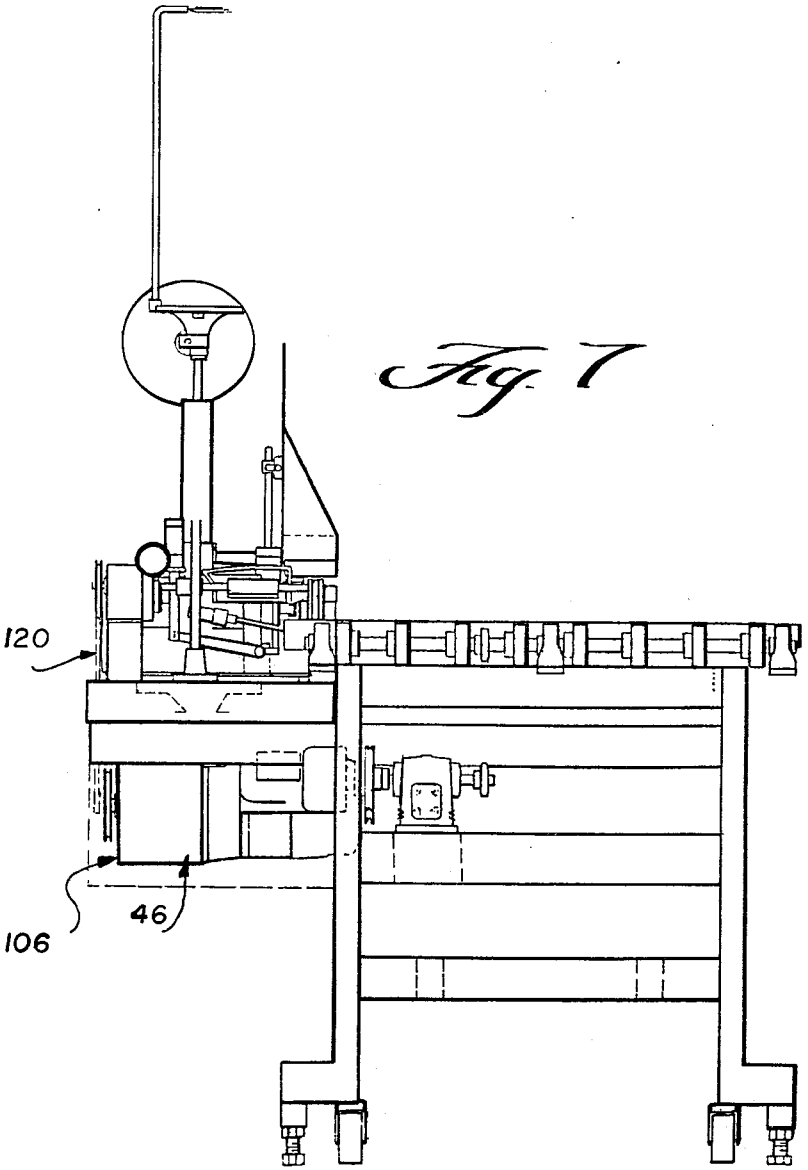
FIG. 7 is a downstream end elevation view thereof.
Figure 6:
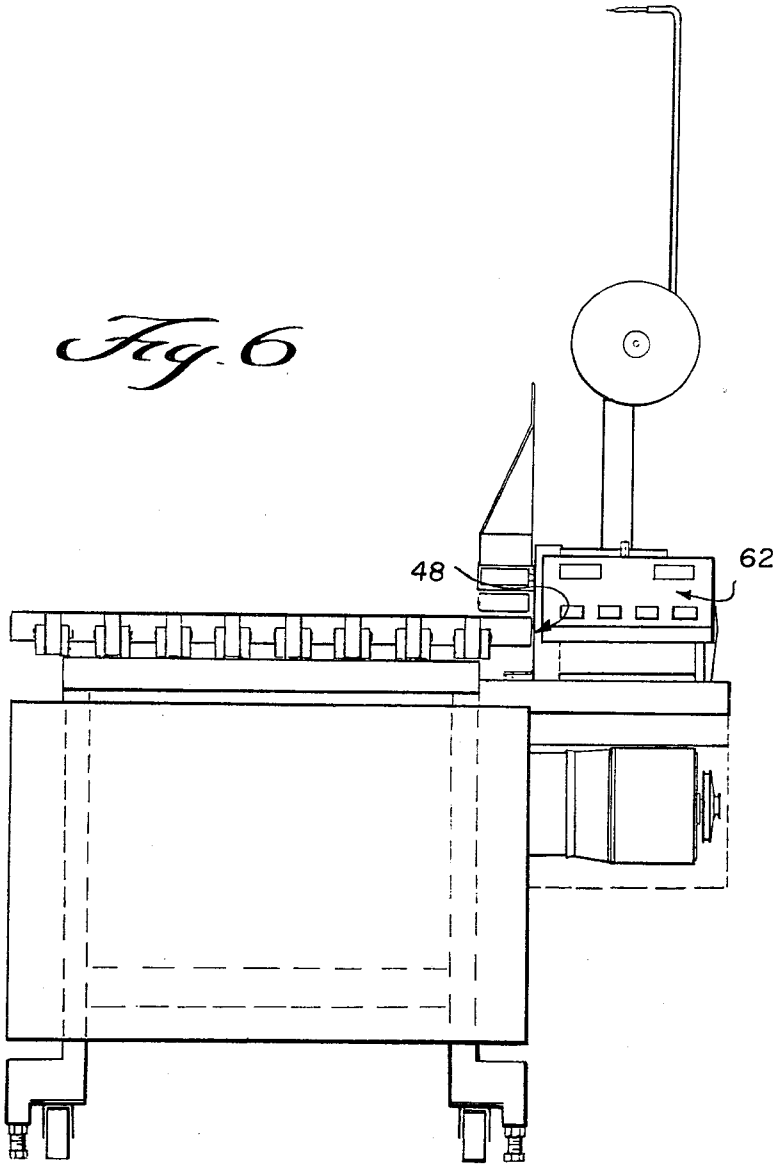
FIG. 6 is an upstream end elevation view thereof.
Figure 8:
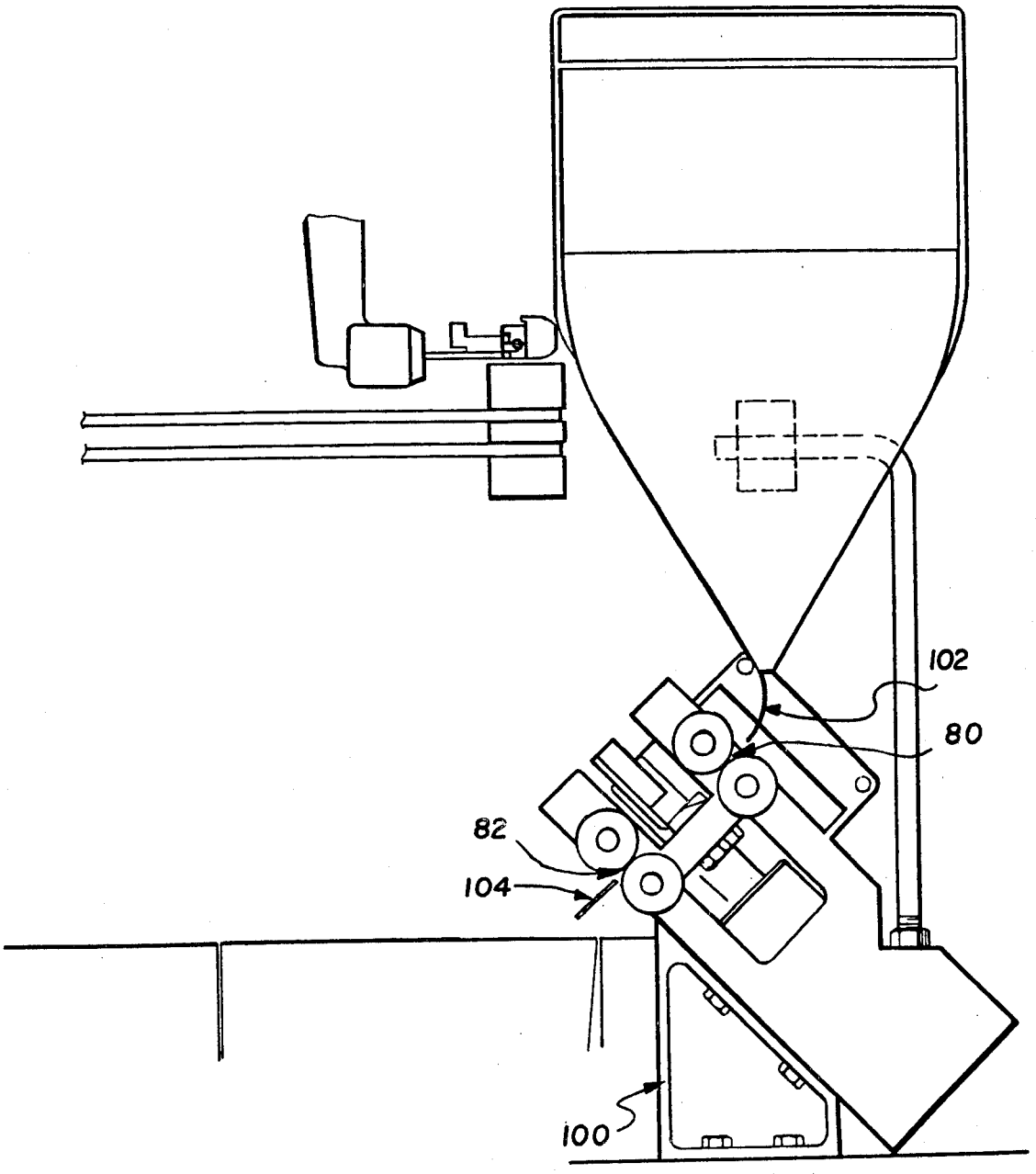
FIG. 8 is a fragmentary opposite side elevational view thereof showing the trim/feed module on a larger scale.
Figure 9:
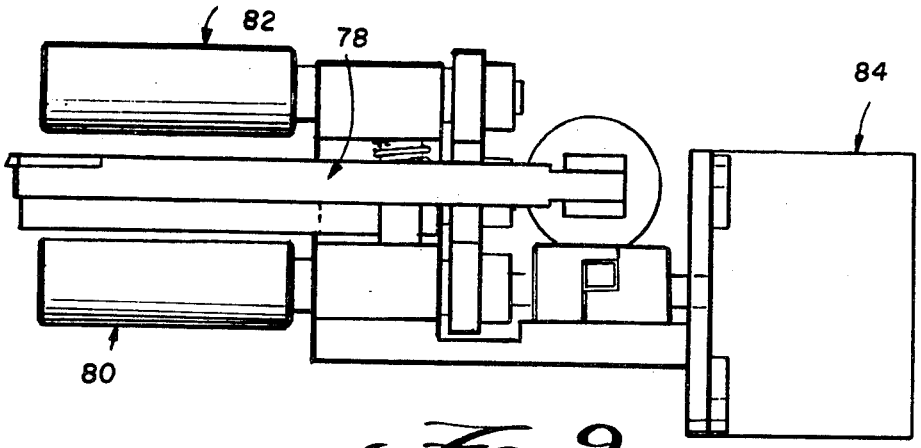
FIG. 9 is an upper end view of the main portion of the trim/feed module.
Figure 11:
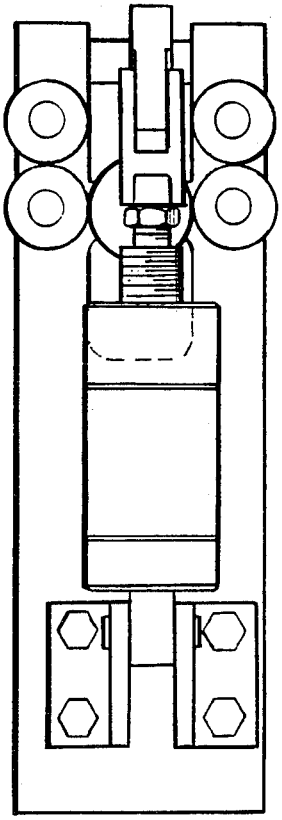
FIG. 11 is an elevational view taken at right angles to FIG. 10 and showing the same side of the module as is presented towards the viewerin FIG. 5.
Figure 10:
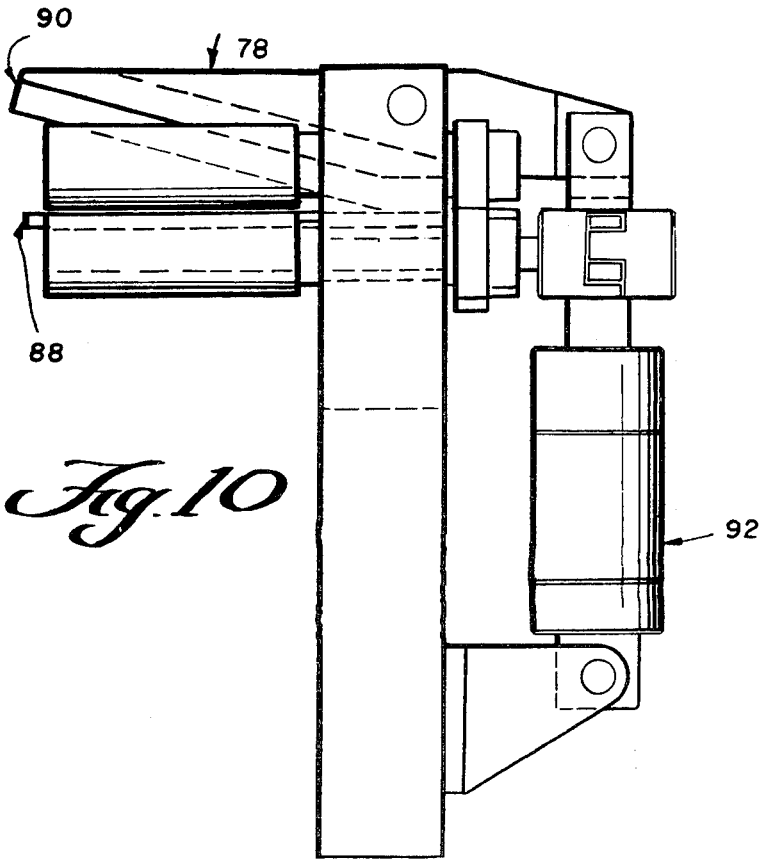
FIG. 10 is an elevational view thereof taken at right angles to FIG. 9 and showing the same face of the module as is presented towards the viewer in FIG. 7.
Figure 12:
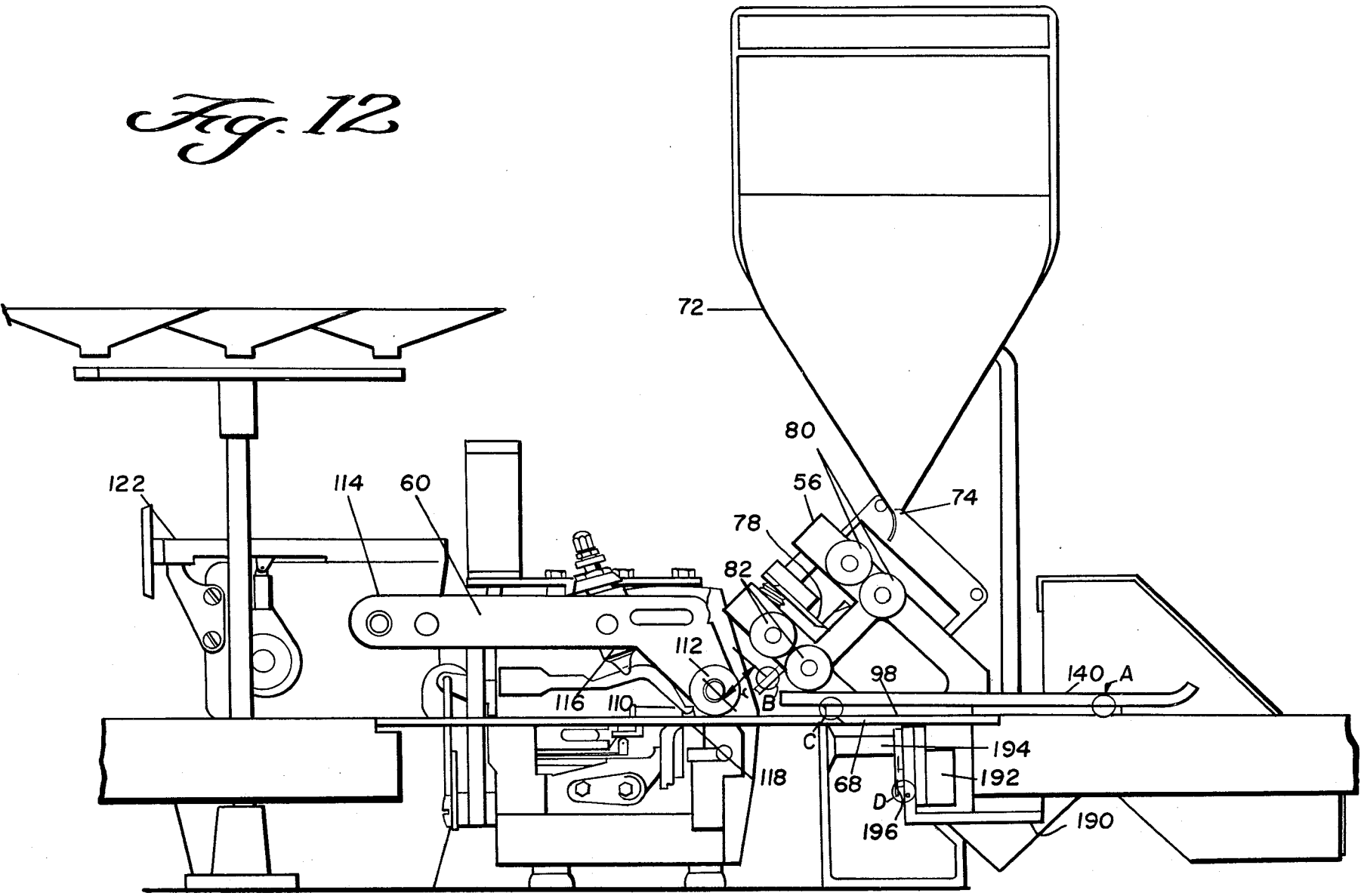
FIG. 12 is a fragmentary side elevation view similar to FIG. 8, but showing additional details of the rib attachment machine, further including the pull roll assembly, the sewing head, and sensor locations.
Figure 16:
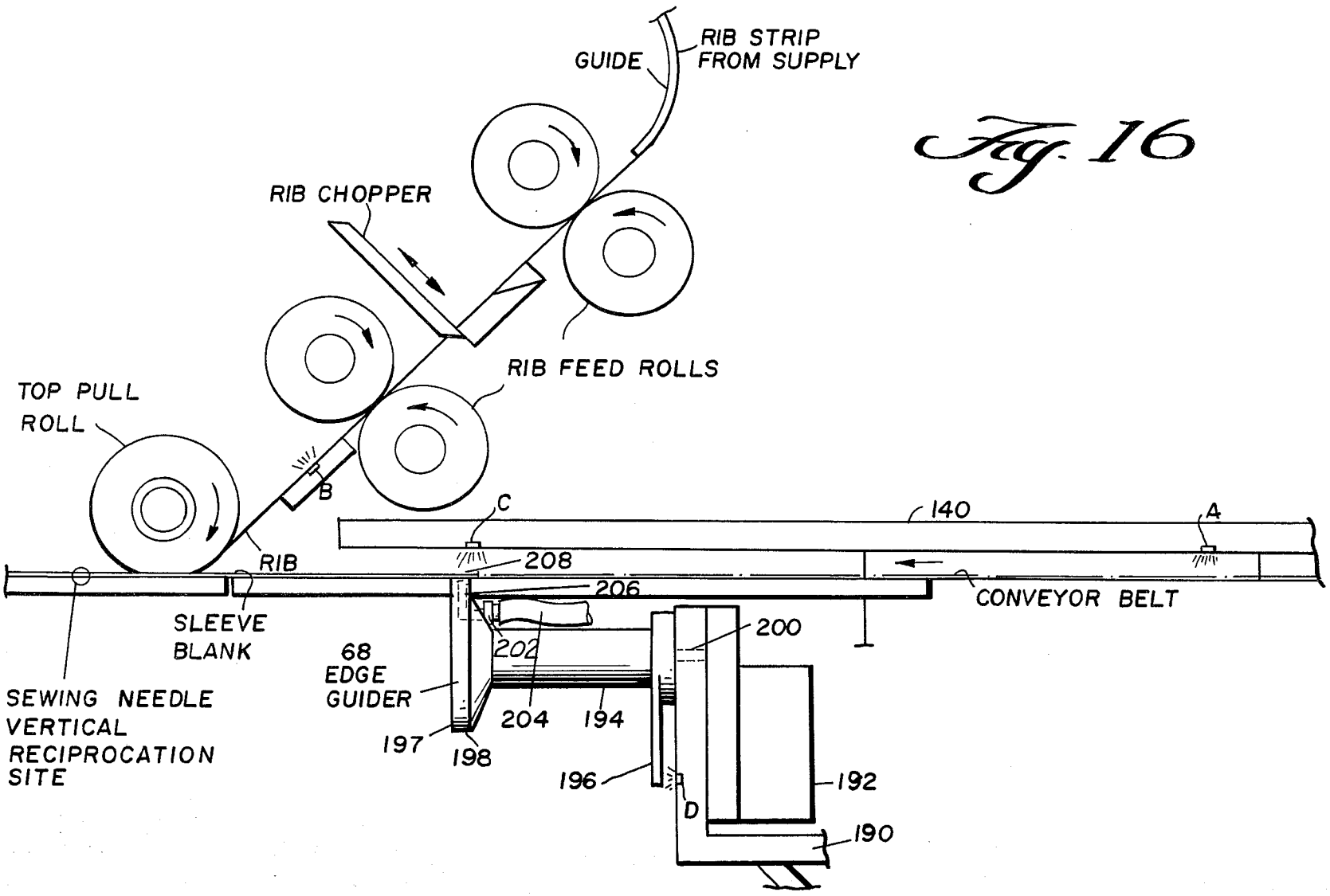
FIG. 16 is a simplified diagram illustrating the apparatus in use and focussing on the same region as is depicted in FIG. 12.

Turning now to FIG. 2, in using the conventional system, in a subsequent step, which may be manually or semi-automatically performed, two pieces P1, P2 of excess cuff rib are trimmed from each sleeve blank unit so that the leading and trailing edges of the cuff rib are even with the leading and trailing edges of the sleeve blank. The cuff rib pieces P1 and P2 become waste, again in an amount which may cost a large manufacturer several thousands of dollars on an annual basis. Through this stage the cuff rib is still doubled-back onto the wrist margin of the sleeve blank. To finish the sleeve, the trimmed cuff rib is folded out and the leading and trailing edges LE, TE of this composite are longitudinally seamed from one end to the other as shown at LS (FIG. 3).

A large manufacturer typically will purchase raw fabric by weight and sell finished apparel by count, and need to buy enough additional fabric to account for the waste which gets trimmed away in the manufacturing process, as just described. By using the apparatus, process and principles of the present invention, a manufacturer can save several ways: The production of waste pieces P1 and P2 may be eliminated; the two stages of rib-cutting between sleeve blanks (as described with reference to FIGS. 1 and 2), may be reduced to one; because a greater accuracy in ply-juxtaposition is facilitated, it is possible to lose less edge material in the seaming operation at the sewing station.

Exemplary apparatus embodying the principles of the present invention will now be described in more detail with reference to FIGS. 4–16, wherein the overall apparatus 10 as shown, is constructed and arranged for alternative use in two modes of operation for attaching rib either to sweatshirt sleeve blanks or to the lower edge of jacket bodies.

In general, the apparatus 10 is seen to include a frame 14, e.g., constructed of steel tubing, including legs 16 which are provided with jackscrews 18 for leveling and casters 20 to permit the entire apparatus to be easily moved to another location. Surmounting the frame 14 is a substantially horizontal, generally rectangular tabletop 22, e.g., made of hardwood. At its upstream end 24 and its downstream end 26, the tabletop is provided with respective end sprocket units 28, 30 of an endless belt conveyor 32 the upper run of which traverses the length of the upper surface 34 of the tabletop and is supported thereon. As shown, the endless belt conveyor 32 is not constituted by a broad unitary belt, but rather by a plurality, e.g. eight relatively narrow belts 36 which run parallel to one another with equal spacing laterally between them. At one end, the conveyor sprocket runs freely; the other conveyor sprocket is powered for rotation by chain 38 to gear reducer 40, through clutch 42, via V-belt 44 from the output shaft of sewing machine motor 46. By powering the conveyor 32 from the sewing machine motor 46, a synchronized speed is achieved. The pieces to be sewn are conveyed to the sewing head at the same speed that the feed dogs of the sewing head move the work through the sewing station.

Intermediate the ends 24 and 26 of the table top, one side edge 48 is shown generally rectangularly notched-away at two adjoining sites 50, 52 (FIG. 4) in order to accommodate the sewing head 54 and the trim/feed module 56. Beside the sites 50, 52 the frame 14 includes a cantilevdred portion which functions as a support table for the sewing head 54, the trim/feed module 56, top pull rolls 60, an operator control panel 62, a thread stand 64 for the sewing head 54, and pressurized air supply means 66. Cover plates 95 and 96 removably cover the remainder of the notches 50 and 52 and have upper surfaces 98 which are flush with the tabletop.

The rib attachment machine 10 preferably is equipped with a suitable automatic unit for laterally adjusting the conveyed pieces as they enter the sewing station. Such an "edge adjuster" unit can be located at 68. One prior art edge-adjuster unit is described in the U.S. patent of Andersson, No. 3,417,718, issued Dec. 24, 1968. However, other means such as an automatically angularly adjusted air-blasting nozzle preferably are used for edge adjustment, as is further described hereinbelow with particular reference to FIG. 12-16.

The sewing head 54 may be utterly conventional. In fact, the apparatus of the invention may be retrofitted to the sewing table of a conventional sewing head. The sewing head 54 which is depicted typically may be a commercially available Union Special Model 39500 overedge sewing head equipped to produce the so-called 504 stitch. Other brands of sewing head also are commercially available for producing the preferred stitch, and would, if used, require minor modifications to the apparatus as shown, in order to accommodate differences in size and the like.

Whereas the conveyor 32 functions as a means for feeding to the sewing head 54, i.e., to and through the work station, a series of discrete items of the first fabric element of the two that are to be united at the sewing head, the trim/feed module 56 serves to meter and cut from a supply strip of indeterminate length, and to feed to the sewing station items of a second fabric element. For instance, the trim/feed module 56 is designed to hold a stock roll of rib knit fabric (e.g. "rib") at 70, to double that fabric over upon itself at 72 to provide a two-ply strip having a fold line at 74 and superimposed edges at 76, to successively chop leading end increments from the supply strip at a cutting knife 78, and to feed the successive leading end increments forwardly and down into superposition with the succeeding first fabric elements (e.g. "fleece") at the sewing head 54.

A rib-knit fabric increment when meant to be attached as sleeve cuff or jacket waistbanding typically has a free length that is approximately two-thirds the length of the margin of the fabric element item (sleeve blank wrist end or jacket body bottom) to which it is to be attached. When that is the case, it is essential that the feeding speed of the rib-knit fabric element be controlled in such a manner as to cause the rib-knit fabric element to be stretched during at least part of the time it is being fed.

To that end, the trim/feed module 56 preferably comprises two sets of pinch rolls 80, 82 through which the leading end of the supply of rib-knit fabric is successively fed on its way to the sewing head. The pinch rolls 80, 82 are driven by a stepper motor 84 having an adjustable speed control 86, e.g. a commercially available Zero-Max unit, so that the desired amount of stretch can be provided to the leading end increment of the rib-knit as it is being fed to the sewing head. The stepper motor 84 of the pinch roll drive preferably is set-up for two-speed operation, "fast" and "slow", which is particularly useful when, as with jacket waistbanding, the middle part of the rib that borders the lower edge of the jacket body desirably is to be stretched to a greater degree than are the two terminal portions which border the lower edge of the left front and right front quarters of the jacket body.

The cutting knife 78 is shown located between the first and second sets of pinch rolls 80, 82 and having the form of a stationary platen 88, a pivotally mounted chopping blade 90, and a pressurized air-operated cylinder 92 for momentarily pivoting the blade 90 against the platen 88 to sever a leading end increment from the supply of rib-knit strip that is being drawn from the supply 70 and fed towards the sewing head 54 by the two sets of pinch rolls 80, 82.

Although the supply and folder 70, 72 of the trim/-feed module are generally vertically oriented on the frame 100, the first and second sets of pinch rolls 80, 82 and the cutting knife 78 are mounted thereon on a decline, e.g. so that the leading end of the second fabric element strip is abstracted generally vertically downwardly from the supply then fed obliquely downwards and downstream at about a forty-five degree angle directly towards the sewing station. In this connection, the doubler 72 of the trim/feed module preferably is provided with a first guide apron 102 which curves from the vertical to the oblique in order to aim the leading end increment of the supply of second fabric element strip from the supply into the nip of the first pinch roll pair 80. Similarly, the frame 100 of the trim/-feed module is preferably provided with an obliquely disposed second guide apron 104 which continues at the angle of inclination of the two pairs of pinch rolls 80, 82, from the outlet of the nip of the second pair of pinch rolls 82, to the close vicinity of sewing head 54.

When the rib attachment machine 10 is being operated to attach rib to sweatshirt sleeve blanks, a human operator or other depositing instrumentality successively deposits sweatshirt sleeve blanks crosswise, flatwise on the conveyor 32 near the upstream end 24 of the tabletop 22. The spacing between succeeding sleeve blanks is not critical, so long as some spacing, longitudinally of the tabletop is left between wrist ends of succeeding sleeve blanks. Of course, it is also necessary that the sleeve blanks all be deposited some side up (e.g. outside up) and with the same end (e.g., the wrist end) adjacent the same side (i.e., the side 48) of the tabletop 22. It is either necessary that a human operator accurately position or adjust the blanks in the lateral direction or that an adjusting instrumentality e.g., an edge-adjuster 68 be provided so that each sleeve blank encounters the sewing head with substantially the same marginal amount of seam allowance.

The rib-knit typically is supplied as a rolled strip that is six inches wide and of indeterminate length. At the conventional folder 72, the rib-knit is doubledover so that it is typically three inches wide, with the superimposed edge margins on line with the sewing station.

The presser foot 110 of the usual, commercially available sewing head 54 is typically much narrower than the aforesaid three-inch width of the typical doubled rib strip. That is because the typical commercially available sewing head 54 is designed to be served by a human operator whose hand or hands typically would be used along side the presser foot 110 to guide the work through the sewing station. However, it is desired that the rib attachment machine 10 be able to be used without the need for human hand-guiding of the work alongside the presser foot. However, because the rib is so much wider than the presser foot 110 and because the rib is under the presser foot in juxtaposition upon the leading edge of the wrist end margin of the sleeve blank, something must be done to mimic the tensioning action of the presser foot across the full width of the rib. One possible way would be redesign the presser foot 110 to make it as wide as the rib. However, another way is preferred as being more flexible and more feasible, and that is to provide a top pull roll device 60 which, in concept, functions as an adjunct of the commercially available presser foot 110.

The top pull roll device 60 is shown having rolls 112 with an endless belt 114 entrained about them. The top pull roll device belt 114 is aligned with the front contact point of the presser foot 110 which it flanks, and is mechanically supported at 116 to be raised and lowered with the conventional presser foot 110. Accordingly, when the presser foot is in contact with the rib-knit, so is the belt 114 of the top pull roll device 60. It is important that the belt 114 run at the same speed as the conventional feed dog 118 associated with the presser foot, to avoid skewing the rib. Accordingly, the device 60 may be powered off the clutch end 106 of the sewing machine motor 46 by a V-belt 120, a Zero-Max speed control unit 122 preferably being interposed in this drive train to permit precise adjustment. By powering the device 60 from the clutch end of the motor 46, the pull roll device 60 is prevented from running while the sewing head 54 is not in operation. The mechanical support 116, as shown, is designed to permit the rolls 112 and belt 114 to be raised out of the way to facilitate rethreading of the sewing head.

The operator control panel 62 is shown disposed at waist level on side 48 of the tabletop 22, next to the trim/feed module 56 and facing towards upstream for easy access by the machine operator.

A conventional chain trimmer 128 is shown associated with the sewing head 54. In normal operation, the purpose of the chain trimmer is to chop-through the chain of sewntogether upper and lower threads slightly after the nowunited two piece of fabric have cleared the sewing station in order to disconnect the sewing head from the work that was just completed and to prepare the sewing head to address the work in the next cycle.

The control system 94 for the trim/feed module preferably incorporates a system of electro-optic sensors, typically photocells of a commercially available type, each of which produces a different electrical signal when "blinded" by any relatively opaque body superimposed fairly directly thereupon, than when "seeing daylight". In the preferred layout depicted, there are five of these sensors shown; they are lablled A, B, C, D and E. Of these, the sensors A, B and C directly relate to operation of the trim/feed module, the sensor D relates to operation of an optional but preferred edge guider for the first fabric element pieces, and the sensor E relates to operation of an optional but preferred stacker-doffer mechanism located downstream from the sewing station (and not shown in detail).

More particularly, the photoelectric cell A is incorporated in the control system 94 in such a manner as to initiate operation of the trim/feed module through a series of time delays T01–T17 as explained further hereinbelow; the photoelectric cell B is incorporated in the control system 94 for stopping feeding of the second fabric element strip so as to bring the leading edge of that strip to a predetermined location, ready for the next incremental feeding thereof; the photoelectric cell C is incorporated in the control system 94 for feeding the second fabric element strip in a controlled manner; the photoelectric cell D provides a homing device for the edge-guider head; and the photoelectric cell E is incorporated in the control system 94 for initiating operation of the aforementioned stacker-doffing system.

The preferred location and spatial orientation of the photoelectric cells A-E are as illustrated. That is, the photoelectric cell A looks down from its mounting in a horizontal transparent (e.g. Plexiglas plastic) guide plate 140 which is mounted to the frame 14 or tabletop 22 so as to spacedly overlie the upper surface of the table-top by about one-quarter of an inch (e.g. by slightly more than the thickness of the conveyor belts 36 plus the thickness of the individual first fabric elements). The guide plate 140 as shown extends from somewhat upstream of directly beneath the trim/feed module 56 to beneath the second set of pinch rolls 82. For example, the photocell A is located nine inches upstream of, and one-half inch inboard of the needle contact point of the sewing station. The photocell B looks up from the second guide apron 104 of the trim feed module three-quarters of an inch downstream of the nip of the second set of pinch rolls 82, one inch upstream along a tangent from the running surface of the adjacent roll 112 of the top pull roll device 60 to the apron 104, and one and one-half inch inboard of the needle contact point of the sewing station. The photocell C looks down from the transparent guide plate 140, three inches upstream of the needle contact point of the sewing station and one-quarter inch outboard thereof. (As shown, the photocell D is disposed under the tabletop looking horizontally at a homing flange of the preferred edge-adjuster unit, and the photocell E looks up from the tabletop twenty-two inches downstream of the needle contact point of the sewing station and twelve inches inboard thereof.) All of the dimensions just given are for illustrative purposes in regard to the preferred embodiment.

The preferred edge-guider 68 includes a mounting bracket 190 mounted to the frame 14 so as to dispose the edge-guider beneath the tabletop 22, under the trim/-feed module 56. A stepper motor 192 is mounted to the bracket 190 and a spool-shaped air guider head 194 is journalled on the bracket 190 for rotation about its own horizontal, longitudinally aligned longitudinal axis. The upstream flange of the spool 194 is shown including a pie-wedge shaped flag 196 which projects radially and generally downwardly. The downstream flange 197 of the spool 194 is shown being generally circular and having a radially outer edge 198. The air guider spool 194 is journalled on the bracket 190 by a spindle 200 which is geared to the stepper motor 192 so that the stepper motor 192 may be operated to angularly move the air guider spool 194 very rapidly by small angular increments clockwise and counterclockwise. The spindle 200 projects through the flange 194, where it swivelably mounts an air hose barb 202, so that the hose barb may remain stationary as the spindle moves. A supply of pressurized air is communicated to the air hose barb 202 by an air hose 204. Within the air guider spool 194, a radially extending channel communicates a small opening 206 directed generally upwards on the edge surface 198, with an air exit channel (not shown) radially from the spindle 200. Accordingly, when air is supplied by the hose 204 to the hose barb 202 to the spindle 200, it issues out of the opening 206 as a very fine blast of air.

The cover plate in the tabletop notch between the trim/feed module and the edge-guider module has a small slot 208 formed therein. A segment of the air guider spool flange 197 is received in this slot from below, to near flushness with the tabletop 22, so that the air outlet opening 206 projects generally upwardly subjacent the photocell C.

The means by which the preferred edge-guider 68 operates should now be generally evident. If no air is issuing out of the opening 206, fleece parts being conveyed along the tabletop toward the sewing station will not be laterally adjusted, contacted, or otherwise affected by the air guider 194, regardless of the angular orientation of the air guider 194. Similarly, if the air supply is activated and is causing a fine blast of air to issue out of the opening 206 but the opening 206 is aimed precisely vertically, fleece parts being conveyed along the tabletop toward the sewing station will not be contacted or laterally adjusted by the air guider, although the fleece part passing over the slot 208 may be lifted slightly, limited by contact with the underside of the overlying transparent guide plate. Also, if no fleece part happens to be passing over the slot 208, whether air is issuing from the opening 206 and the angular orientation of the opening 206 relative to vertical is immaterial; there is no effect on the fleece parts being conveyed. However, if while a fleece part is passing over the slot 208, the air supply is operated to blow air out the opening 206 and the stepper motor 192 is operated to angularly deviate the opening clockwise or counterclockwise from verticality by no more than a few degrees, the issuing air blast will have a "steering" effect on the fleece part, i.e. to tug the fleece part closer to the adjacent edge of the table so that it overlaps the imaginary longitudinal line along the tabletop to the needle contact point of the sewing station by a greater amount or to push the marginal end portion of the fleece part further back from the adjacent edge of the table so that it overlaps that imaginary line by a lesser amount, depending on the direction and magnitude of the angular deflection of the air guider 194.

Although separate sets of photocells or other sensors could be used to sense whether the edge of the fleece part about to enter the sewing station was located too close to the adjacent tabletop edge or too far away, and the air guider correspondingly rotated one way or the other depending on the sensation, another way is preferred. Namely, if a person or some device is depositing the fleece parts one by one on the upstream end of the conveyor approximately with the proper alignment with regard to the transverse direction of the tabletop, then, if that person or device can be counted upon to always err, if at all, in one direction, then the air guider need only be set up so as to adjust in the opposite direction. For example, if the fleece parts are each deposited on the conveyor with the relevant edge located just right or too far from the table edge, then the air guider need only be operable to tug the fleece parts closer to the table edge. Or, if the fleece parts are each deposited on the conveyor with the relevant edge located just right or too close to the table edge, then the air guider need only be operable to push back the marginal edge portion of the fleece part that is entering the sewing station. In fact, the latter alternative is more presently preferred, because less air pressure is needed to push a little of the fleece part back then is needed to pull all of the fleece part or to sufficiently stretch the fleece part. Further, the photocell C can in such an instance be connected in the control system 94 so as to do double duty, for it can serve as the sensing means for determining how much, if at all, the air blast from the air guider needs to be angulated in order to push the edge of the fleece part that is about to enter the sewing station transversally of the table so that the desired uniform, small amount of marginal edge will be caught in the seam by the sewing head. (The photocell D is arranged to look at the flag 196, so that if the air guider should be angulated too much in a futile attempt to guide a seriously misaligned edge, the stepper motor can be operated to forsake the attempt and get the air guider ready for operating on the next fleece part due to come along.)

The preferred control system 94 will now be further explained, having particular reference to FIGS. 12–16.

Referring to FIG. 14, in the preferred embodiment the control system 94 includes five printed circuit boards, namely, a processor board 142, a stepper motor control board 144, a level-shift/power supply board 146, a keyboard/display board 148 and a sensor buffer board 150.

The processor board 142 contains a microprocessor, memory devices (RAM, EPROM and EAROM), inputs from sensors and keys, and outputs to drive solenoids, displays, motors and the like.

The stepper motor control board 144 accepts motion commands outputed from the processor board 142 and translates them into signals appropriate for driving the stepping motor 84 of the pinch roll sets 80, 82, and the stepping motor 152 of the edge-guider 68.

The level shift/power supply board 146 receives stepped-down AC line voltage and produces DC voltages for powering the rest of the system 10, and translates processor board outputs for driving solenoids, brake, clutch and the stacker-doffer.

The keyboard/display board 148 of the operator's control console 62 (shown diagrammatically in FIG. 15) includes a 4-digit display unit 154, eleven keypad switches 156, (shown marked UP, DOWN, JOG, RESET, COUNT, RIB, CHOP, SEW, TRIM, MODE and POWER), a privilege key switch 158, and six indicator LED's 160 for communication with the operator and with set-up personnel.

The sensor buffer board 150 receives low-level signals from the optical sensors A-E and amplifies them for reliable inputing to the processor board 142.

The main function of the control system 94 is coordinated automatic operation of the trim/feed module pinch roll-driving stepper motor and rib-chop solenoid, the edge-guider 68, the sewing head 54, and stacker/doffer.

The operator's supervisor, through use of the privilege key switch 158, is enabled to reset the accumulated number of doffer cycles. The operator may display and change the number of pieces stacked in the current doffer cycle, and the number of pieces to be run before the doffer will cycle, and may cause the display 154 to indicate the number of doffer cycles which has accumulated, but cannot alter that number. Accordingly, the control system 94 can function as an integral part of an output-related worker pay accounting system. Set-up personnel preferably may examine and change most control system parameters from the operator's panel 62.

During normal operation of the delive 10, when the operator depresses the POWER key on the panel 62, an ON/OFF control board applies power to a main contactor; line voltage is then applied to a power transformer 162, which provides stepped-down AC voltage to the level shift and power supply board 146. The microprocessor of the processor board 142 performs a self-test, which either terminates normally, and briefly displays the numeral "8888" at 154, or terminates abnormally, displaying diagnostic information at 154 so that the detected fault may be corrected. If the self-test has terminated normally, the stepper motor 84 will then run unless and until second fabric strip, e.g. rib is covering the sensor B.

MODE - During normal operation, pressing this key causes recall to the display 154 of the current mode, either J for jacket or S for sweatshirt. The operator may toggle this state by pressing the MODE key again until the displayed mode is the state desired. This state is preserved in the EAROM of the processor board until changed again by the operator.

UP - Pressing of this key is recognized only when the control is in automatic operation mode, or when the COUNT or MODE LEDs are illuminated. When the key is recognized, it causes the display 154 to begin to count up, first at a rate of about 2.5 counts per second, gradually increasing to a maximum rate of about 15 counts per second. When the maximum value of 9999 is reached, the display remains at 9999. (In the case of automatic operation, the upper limit is one less than the prescale value).

DOWN - Pressing of this key is recognized, as above, when in automatic operation or when the COUNT or MODE LEDs are illuminated. Operates similarly to the UP key, except the display counts down. When the minimum value of 0 is reached, the display remains at 0.

COUNT - Pressing of this key displays the number of doffer cycles while the key is depressed. While the LED is illuminated, but the key is not depressed, the display shows the prescaler value. The UP and DOWN keys may be used at this time to alter the prescale value to be used during operation.

When the privilege key swith 158 on the panel 62 is actuated, the doffer cycle count may be cleared by depressing the COUNT key and the RESET key simultaneously. This puts the system in automatic mode, ready for operation. The key switch may then be restored to its normal deactivated position. In this deactivated state of the key switch, the COUNT-RESET combination will still cause reset to the automatic state, but the doffer cycle count will remain unchanged.

JOG - This key is used to activate the various special operating mode keys, as follows:

- RIB: This key, when depressed, runs the stepper motor 84 of the feed rolls 80, 82 in its slow speed as long as the JOG key is held down.
- CHOP: This key, when depressed, initiates the chop cycle, once, when the JOG key is depressed. The JOG key must be depressed again to cycle the rib chop blade 78 again.
- SEW: This key, when depressed, runs the sewing machine 54 as long as the JOG key is held down.
- TRIM: This key, when depressed, initiates the chain trim operation at 128. The chain trim operation is repeated at the completion of the trim cycle if the JOG key remains depressed.

Further during normal operation of the device 10, the piece count is normally displayed at 154. The piece count is a number which begins at zero and counts up to a preselected i.e. "prescale" value, minus one. The UP and DOWN keys may be depressed at any time during automatic operation of the system 10, for adjusting the piece count as displayed. When, as the system 10 continues to operate the piece count reaches the prescale value, the processor board signals the level shift and power supply board to operate the doffer, and the piece count displayed at 154 is cycled to zero.

The RESET key may be pressed by the operator at any time. It causes the control system 94 to prepare for automatic operation. If the system is already operating automatically when the RESET key is pressed, pressing that key has no effect. However, if the control system 94 is operating in a special mode, as described below, pressing the RESET key returns the control system 94 to its normal operating mode, triggering brief self-testing and perhaps running of the stepper motor 84, both as described above in relation to pressing the POWER button.

By preference, much of the control system elements, but for the operator's control panel 62 are housed in a closeable secondary housing 130 where it is inaccessible to the operator, though accessible to supervisory and set-up personnel. Although just as outlined, many set-up functions can be performed right at the operator's control panel, without accessing the contents of the secondary housing, some set-up functions require that access be had to the contents of the secondary housing, as will now be outlined in more detail.

The processor board 142 includes a set-up switch which, when manually activated by set-up personnel causes the display unit 154 to show, instead of the piece count in the current doff cycle as it does in normal operation, the rib motor 84 high speed rate in counts per second. The motor 84 does not run unless the JOG key is maintained depressed, at which time the motor 84 begins running at its slow speed and immediately thereafter ramps to its high speed. Accordingly, a control pot on the stepper motor control board 144 may be adjusted by the set-up personnel and the adjusted speed become shown in the display unit 154. The rib motor 84 slow speed may be similarly displayed and adjusted by additionally depressing the RIB key.

While the set-up switch in the housing 130 remains activated, the MODE key is operable as follows. When the MODE key is depressed, the display unit 154 displays the first of the time delays currently stored in the EAROM of the processor board 142. Then each depression of the JOG key causes the next of the as presently established time delays to be recalled to the display unit 154. While displayed, each time delay may be altered by pressing the UP or DOWN key. After the last of the established time delays has been displayed, the next pressing of the JOG button will begin the cycle again, causing the first of the time delays currently stored to be displayed. Pressing the RESET key or another of the mode keys causes the system to leave this time delay displaying mode.

A typical set of time delays as would be displayed when performing the set-up function just described, is shown in FIG. 13.

In the normal automatic operation of the device 10, e.g. to attach knit cuff rib to the cuff ends of fleece sweatshirt sleeve blanks or knit waistbanding rib to fleece jacket body bottom edges, as the leading edge of the fleece part covers photocell A, photocell A activates rib feed time delay T01 and enable edge guide time delay T02. When time delay T02 has cycled, the edge-guider stepper motor and edge-guider air are turned on. Photocell C detects the fleece part and causes the edge-guider head to oscillate, directing its air jet in a direction as to manipulate the fleece part transversally of the sewing table into the proper position in relation to the sewing head needle. Upon completion of the rib feed time delay T01, T03 sew delay-rib feed high dwell is activated and the rib stepper motor 84 is turned on for rib feed fast at the point where T03, sew delay time is complete. Next, there is a divergence in operation depending on whether the control system MODE key is set to J for jackets or S for sweatshirts. If it is set to J, T04 is operable. T04 governs jacket front dwell along with brake off, engage sew motor clutch, and presser foot down. When T04, jacket front dwell time is complete the rib stepper motor 84 is changed from fast speed to slow speed. While still in the jacket mode, when the trailing edge of the fleece part uncovers photocell A, photocell A activates T06, jacket rib fast delay, T07, jacket rib stop delay, T09 edge guide dwell and T10, stop sew delay. Upon completion of T06, jacket rib fast delay, the rib stepper motor will again be changed into the fast speed. However if the MODE key is set to S for sweatshirts, T05 is operable. T05, rib feed slow will be activated along with brake off, engage sew motor clutch, presser foot down and the rib stepper motor will be turned off.

At the completion of time for T05, rib feed slow delay, the rib stepper motor will be turned on in the slow speed. While in the sweatshirt mode the trailing edge of the fleece part uncovers photocell A, photocell A activates T08, sweatshirt rib stop delay, T09, edge-guide dwell and T10 sew stop delay. Upon completion of T08, sweatshirt rib stop delay, T11 rib chop delay will be activated and the rib stepper motor will be turned off when time is complete for T07 jacket rib stop delay or T08 sweatshirt rib stop delay. Upon completion of T11 rib chop delay, in either the jacket mode or the sweatshirt mode, the rib knife will be energized and the rib severed, T12, rib chop dwell will simultaneously be activated. When T12 rib chop dwell time is complete the rib knife will be retracted and T13, rib feed fast delay will be activated. Upon completion of T13, rib feed fast delay, the rib stepper motor will be turned on in the fast speed. If in the sweatshirt mode T14, rib fast dwell will be activated. At the completion of T14, rib fast dwell, the rib stepper motor will be changed from the fast speed to the slow speed.

At this time the rib part will be advanced to a point where the leading edge will cover the photocell B and the rib stepper motor will be turned off and the leading edge of the rib part will be in a position in readiness for the next cycle. When T09, edge guide dwell time is complete, photocell D will signal the edge-guider stepper motor to home to the center position and the edge-guider stepper motor and edge-guider air will be turned off until signaled for the next cycle. When T10, stop sew time is completed, the sew motor brake will be energized, T15, brake dwell and T16, chain trim delay will be activated, the sew motor clutch will be released and the presser foot will be lifted. When T15, brake dwell time is complete the sew motor brake will be released. Upon completion of T16, chain trim delay, the chain trim knife will be energized and the sew chain will be severed and T17, chain trim dwell will be activated. Upon completion of T17 chain trim dwell, the chain trim knife will be retracted in readiness for the next cycle.

As photocell E is covered, T18, the stacker delay is activated. When time is complete for T18, the stacker is energized and the sewn part is removed from conveyor, also T19, stacker dwell, is activated. When T19, stacker dwell is complete, the stacker returns to ready position and incrementally increases the sewn parts piece count on the display unit 154. When sewn parts piece count reaches the present number T20, doffer delay is activated. When T-20 doffer delay is complete the doffer is energized removing the sewn parts from the stacker depository and activating T21, doffer dwell. When T21, doffer dwell is complete the doffer is returned to the ready position and incrementally increases the doff cycle count.

It should now be apparent that the lateral position adjuster for edge margin of longitudinally conveyed flexible material as described hereinabove, possesses each of the attributes set forth in the specification under the heading "Summary of the invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. For use in conjunction with a conveyor having a generally horizontal, upwardly facing, longitudinal run along which at least one body of flexible sheet-like material having an edge extending generally longitudinally of the conveyor run is to be conveyed through a work station juxtaposed with the conveyor run at a site, which work station includes a work head in an instance wherein it is important that as the body passes through the work station, the margin of said edge be disposed in a predetermined laterally uniform juxtaposition with said work head, a lateral position adjuster for the body, comprising:

pressurized air outlet nozzle means; means mounting said air outlet nozzle means so that said air outlet nozzle means is aimed generally vertically but may have its aim shifted generally angularly about a generally horizontal axis which is arranged to extend generally longitudinally of said conveyor run; and motor means for shifting the aim of said nozzle means about said axis; means for supplying pressurized air to said outlet nozzle means; means for sensing whether as successive increments of said body approach the site of the work station such edge margin is laterally deviated from said predetermined laterally uniform juxtaposition; and control means operatively connecting said sensing means with said motor means so that as an increment of said body of material is sensed to be laterally displaced from said predetermined laterally uniform juxtaposition, said motor means is operated to angulate said nozzle means in a remedial sense, so that as pressurized air issues from said nozzle means at a lateral angle towards the respective increment of said body of material, said edge margin of said increment of said body of material is shifted laterally towards said predetermined laterally uniform juxtaposition.

2. The lateral position adjuster of claim 1, wherein:

said pressurized air outlet nozzle means is constructed and arranged to provide a needle-like, narrowly confined blast of air.

3. The lateral position adjuster of claim 2, wherein:

said air outlet nozzle means is disposed to look generally upwardly.

4. The lateral position adjuster of claim 3, further including means mounting a back-up plate in close overlying relation to said air outlet nozzle means, but with adequate space provided vertically therebetween for passage of said body of flexible sheet-like material, so that as said air nozzle means is operated, said body of flexible sheet-like material may lift slightly at said edge margin thereof into contact with said back-up plate, but may not blow away into an unwanted, doubled-over condition.

5. The lateral position adjuster of claim 4, wherein:

said sensing means includes normally-viewing photoelectric cell looking downwardly from a mounting thereof in said back-up plate.

6. The lateral position adjuster of claim 5, wherein:

the back-up plate is made of transparent material so that a human operator may observe the body of flexible sheet-like material as the edge margin thereof passes under said back-up plate.

7. The lateral position adjuster of claim 1, wherein:

said motor means is a stepper motor constructed and arranged to angularly shift the aim of said air outlet nozzle means through a variable angle, the magnitude of which is determined by the magnitude of lateral deviation sensed by said sensing means.

8. The lateral position adjuster of claim 7, adapted for use in conjunction with said conveyor when a succession of like said bodies of flexible sheet-like material is to be conveyed through said work station arranged one after the other on said conveyor run, with possible initial disparity in the lateral disposition of the respective said edge margin of each such body, said lateral position adjuster further including:

control means operatively connected between said sensing means and said motor means for operating said motor means to return said air nozzle means to a datum position when steering of an edge margin of a respective said body is not needed; and means for sensing whether the air outlet nozzle means has been angularly moved to such an extreme in order to attempt, in vain, to fully adjust the lateral position of the edge margin of a leading said body that unless the air outlet nozzle means is soon moved back to a datum position it will not be ready to cope with whatever need there may be to laterally adjust the lateral disposition of the edge margin of the next succeeding said body coming along the conveyor run and for causing the air outlet nozzle means in that instance to abandon its effort as to the leading said body, and said motor means to reposition the air outlet nozzle means to said datum position.

9. The lateral position adjuster of claim 8, wherein:

said air outlet nozzle means comprises a generally spool-like body having two opposite end flanges; means defining a passageway axially into said spool-like body and radially out of one of said flanges; an axle; said spool-like body being connected by said axle to said motor means; said pressurized air supply means including means connecting with said passageway axially into said spool-like body.

10. The lateral position adjuster of claim 9, wherein:

one of said flanges includes a generally pie wedge-shaped flag; and said means for sensing whether the air outlet nozzle means has been angularly moved to such an extreme that unless soon returned to a datum position it will not be ready to cope with the next succeeding said body comprises a photoelectric cell disposed to look at and normally to be blinded by said flag.

11. A method for laterally adjusting the edge margin of longitudinally conveyed flexible material, comprising:

longitudinally conveying at least one body of flexible, sheet-like material, along a generally horizontally, upwardly facing, longitudinally extending conveyor run through a work station juxtaposed with a site on the conveyor run, where each said body includes an edge extending generally longitudinally of the conveyor run and where the work station includes a work head, in an instance wherein it is important that as each body passes through the work station, the margin of said edge be disposed in a predetermined laterally uniform juxtaposition with said work head;

sensing whether as successive increments of said at least one body approach said site of said work station the respective body edge margin is laterally deviated from said predetermined laterally uniform disposition; and blowing a stream of pressurized air from an air nozzle aimed generally vertically toward the edge margin of the at least one body immediately upstream of the work head, with said air nozzle being more particularly aimed angularly about a horizontal axis extending longitudinally of said conveyor run, in response to said sensing, so as to direct said air stream at said edge margin in such a sense as to laterally adjust said edge margin towards accomplishment of said predetermined laterally uniform disposition.

12. The method of claim 11, wherein:

said at least one body of flexible material is a respective piece of textile fabric, the edge margin of which may be collapsed toward the remainder thereof should said edge margin be pushed toward the remainder thereof, without need for shifting said at least one body, entirely, bodily, laterally of the conveyor run.

13. The method of claim 12, wherein:

said at least one body of flexible material is constituted by a succession of like such bodies closely spaced from one another longitudinally along said conveyor run.

14. The method of claim 13, comprising:

the preliminary step of laying each piece of textile fabric on the conveyor in such a manner that if its respective said edge margin does not have said predetermined laterally uniform disposition upon reaching said air nozzle, then it is laterally out of position in the one sense which may be corrected by collapsing the edge margin of that piece laterally back towards the remainder of that piece without need for shifting the respective said piece entirely, bodily, laterally of said conveyor run.

* * * * *